US007883256B2

(12) United States Patent
Winkler

(10) Patent No.: US 7,883,256 B2
(45) **Date of Patent: *Feb. 8, 2011**

(54) ELECTRONIC DEVICE INCLUDING OPTICAL GUIDE PROVIDED WITH AT LEAST TWO GROUPS OF INTERLACED OPTICAL EXTRACTORS

(75) Inventor: Pascal Winkler, Saint-Blaise (CH)

(73) Assignee: Asulab S.A., Marin (CH)

( * ) Notice: Subject to any disclaimer, the term of this patent is extended or adjusted under 35 U.S.C. 154(b) by 398 days.

This patent is subject to a terminal disclaimer.

(21) Appl. No.: 11/720,804

(22) PCT Filed: Nov. 11, 2005

(86) PCT No.: PCT/EP2005/055930

§ 371 (c)(1),
(2), (4) Date: Jun. 4, 2007

(87) PCT Pub. No.: WO2006/058836

PCT Pub. Date: Jun. 8, 2006

(65) Prior Publication Data

US 2009/0109651 A1 Apr. 30, 2009

(30) Foreign Application Priority Data

Dec. 2, 2004 (EP) ..... 04028559

(51) Int. Cl.
*F21V 7/04* (2006.01)

(52) U.S. Cl. ..... 362/615; 362/626; 362/620; 362/26; 362/23

(58) Field of Classification Search ..... 362/604–605, 362/615–629, 23, 26, 30
See application file for complete search history.

(56) References Cited

U.S. PATENT DOCUMENTS 1,930,359 A 10/1933 Hildenberg (Continued)

FOREIGN PATENT DOCUMENTS

BE 498065 1/1951

(Continued)

OTHER PUBLICATIONS

Office Action issued in related co-pending U.S. Appl. No. 11/720,790, filed Jun. 4, 2007, dated May 14, 2009.

(Continued)

*Primary Examiner*—Robert J May
(74) *Attorney, Agent, or Firm*—Griffin & Szipl, P.C.

(57) ABSTRACT

There is disclosed a timepiece (40) including optical means for forming a decorative pattern, in the form of a figurative image, in response to an action by the user. The optical means forming a figurative image include an optical guide (1, 51) having two large faces (10, 11) and at least one lateral face (12). Optical extractors (19) each having at least one light reflective surface (20) are arranged in at least one of the large faces (11). A light source (8, 8*a*, 8*b*, 8*c*) is arranged so as to emit light in the direction of the reflective surfaces (20), via the lateral face (12) of the optical guide. Thus, each of the reflective surfaces causes a reflected light beam to form in a well defined direction, the set of light beams forming a figurative image in that direction, which can typically be selected as the normal with respect to the mid-plane of the watch.

19 Claims, 3 Drawing Sheets

U.S. PATENT DOCUMENTS

| | | | | |
|---|---|---|---|---|
| 2,290,278 | A | 7/1942 | Failla | |
| 2,290,750 | A | 7/1942 | Howe et al. | |
| 2,916,871 | A | 12/1959 | Wegner | |
| 3,490,226 | A | 1/1970 | Anderson et al. | |
| 3,899,871 | A | 8/1975 | Kitai | |
| 4,541,727 | A | 9/1985 | Rosenthal | |
| 4,761,715 | A | 8/1988 | Brooks | |
| 4,834,475 | A | 5/1989 | Robinson | |
| 4,992,704 | A * | 2/1991 | Stinson | 315/312 |
| 4,999,822 | A * | 3/1991 | Blackburn | 368/228 |
| 5,400,304 | A | 3/1995 | Offenstein | |
| 5,743,616 | A | 4/1998 | Giuliano et al. | |
| 5,984,485 | A | 11/1999 | Poli et al. | |
| 6,452,872 | B1 | 9/2002 | Teijido et al. | |
| 6,463,012 | B1 | 10/2002 | Bar-Yona | |
| 6,473,554 | B1 | 10/2002 | Pelka et al. | |
| 6,690,623 | B1 | 2/2004 | Maano | |
| 6,745,506 | B2 * | 6/2004 | Maas et al. | 40/546 |
| 6,806,644 | B2 | 10/2004 | Ueno et al. | |
| 7,038,975 | B2 | 5/2006 | Ferri et al. | |
| 7,038,976 | B2 | 5/2006 | Winkler et al. | |
| 7,128,460 | B2 * | 10/2006 | Hosobuchi | 362/626 |
| 2004/0213088 | A1 | 10/2004 | Fuwasawa | |

FOREIGN PATENT DOCUMENTS

| | | | |
|---|---|---|---|
| BE | 671105 | | 4/1966 |
| EP | 0 282 934 | | 9/1988 |
| EP | 0 616 922 | A1 | 9/1994 |
| EP | 0 786 685 | | 7/1997 |
| FR | 992.254 | | 10/1951 |
| JP | 58075085 | | 5/1983 |
| JP | 8-271650 | | 10/1996 |
| WO | WO 2004055559 | A1 * | 7/2004 |
| WO | 2004/097773 | | 11/2004 |

OTHER PUBLICATIONS

International Search Report issued in corresponding application No. PCT/EP2005/055930 completed May 30, 2006 and mailed Jun. 6, 2006.

* cited by examiner

Fig. 2bis

ELECTRONIC DEVICE INCLUDING OPTICAL GUIDE PROVIDED WITH AT LEAST TWO GROUPS OF INTERLACED OPTICAL EXTRACTORS

This is a National Phase Application in the United States of International Patent Application No. PCT/EP2005/055930 filed Nov. 11, 2005, which claims priority on European Patent Application No. 04028559.5, filed Dec. 2, 2004 The entire disclosures of the above patent applications are hereby incorporated by reference.

FIELD OF THE INVENTION

The present invention concerns an electronic device such as a timepiece including a case closed by a crystal and inside which there is housed an optical device for forming a figurative image visible through said crystal.

BACKGROUND OF THE INVENTION

Timepieces of this type are known from the prior art. By way of example, EP Patent Application No. 0 786 685, filed on $16^{th}$ Jan. 1997 in the name of SMH Management Services AG, discloses a timepiece comprising a device displaying a coloured decorative pattern. This document implements an optical valve located between a film on which the decorative pattern is printed and the timepiece crystal. When the optical valve is not being supplied with electrical energy, it appears black whereas when it is being powered, it becomes transparent thus making the decorative pattern visible.

This system has, however, a certain number of drawbacks, including in particular high manufacturing cost. The optical valve is preferably made in the form in a liquid crystal cell carrying transparent electrodes on each of its main faces for polarising the liquid crystals. Thus, deposition of the electrodes on the cell faces requires a method whose cost is not negligible, in particular if the optical system is to be implemented in a device for the general public at a low cost price. Moreover, this optical system is very complex in terms of electrical connections as regards the electrical powering of the liquid crystal control electrodes.

SUMMARY OF THE INVENTION

It is an object of the present invention to overcome the aforementioned drawbacks of the prior art by supplying a device, particularly for a timepiece, for displaying a decorative pattern that can be implemented at a lower cost.

The invention therefore provides in particular a timepiece of the aforementioned type characterized in that the optical device further includes a first optical guide with two large faces and at least one lateral face, a plurality of extractors being arranged on one of the large faces, each of the extractors having predefined geometrical features including at least one reflective surface. The optical device according to the present invention further includes at least one light source arranged facing the lateral face in a predefined direction to emit light inside the optical guide and cooperate with the reflective surfaces to form the figurative image directly defined as a function of the geometrical features of the extractors, by reflecting light onto the reflective surfaces.

Alternatively, the optical extractors could each include at least one refractive surface, as the light extractor surface, instead of the reflective surface.

The invention proposes in particular an electronic device including a case inside which there is housed an optical device for forming at least one figurative image in a first predefined direction in relation to the case, the optical device including, on the one hand, at least one optical guide having two large faces and at least one lateral face and, on the other hand, at least one light source, which emits light inside the optical guide, of the type in which the light emitted by the light source cooperates with optical extractors that are arranged on one of said large faces to form the figurative image, characterized in that it includes at least two groups of optical extractors, a first group of optical extractors corresponding to a first figurative image and a second group of optical extractors corresponding to a second figurative image, a first light source being arranged for cooperating with the first group of optical extractors and a second light source being arranged for cooperating with the second group of optical extractors, in that each of said extractors has predefined geometrical features including at least one reflective or refractive surface, such that the set of light beams emitted by the light source that are reflected or refracted respectively by a group of optical extractors forms a network of light beams which generates the corresponding figurative image, in that the light source is arranged in proximity to the lateral face of the optical guide, the light source emitting light in a predefined direction such that it is reflected on the reflective surfaces, respectively such that it is refracted on the refractive surfaces, and in that the first and second groups of optical extractors are interlaced on said large face of the optical guide.

Other advantageous features of the electronic device according to the invention are defined in the claims of the present application.

The optical guide according to the present invention can be arranged on the dial of the timepiece, can fulfil the function of a dial, alternatively, or be made directly in the timepiece crystal.

Preferably, the light source is arranged at the periphery of the case so that it is not visible through the crystal, for obvious aesthetic reasons.

Owing to the aforementioned features, the timepiece according to the invention has an attractive appearance for the user because the decorative pattern, or figurative image, thereby obtained is illuminated when the light source is being powered, whereas the optical guide is almost invisible when the light source is not being powered.

A large number of variants of the aforementioned optical device can advantageously be devised.

In particular, a multi-coloured figurative image could be formed by implementing a plurality of groups or networks of extractors in the optical guide, each group of extractors being associated with its own light source.

Moreover, single coloured or multi-coloured animated patterns could be displayed, on the basis of the aforementioned variant, by powering the light sources sequentially.

The various extractor groups could be arranged in different areas of the optical guide or be interlaced in the same area. Alternatively or by way of complement, two or more optical guides could be superposed, each of the optical guides carrying at least one group of extractors.

Other variants will be described in the following detailed description.

BRIEF DESCRIPTION OF THE DRAWINGS

Other features and advantages of the present invention will appear more clearly upon reading the following detailed description, made with reference to the annexed drawings, given by way of non-limiting example and in which:

FIG. 2*bis* is a similar view to that of FIG. 2 which shows a variant in which the light source is oriented orthogonally to one of the large faces of the light guide;

DETAILED DESCRIPTION

Figure 1:
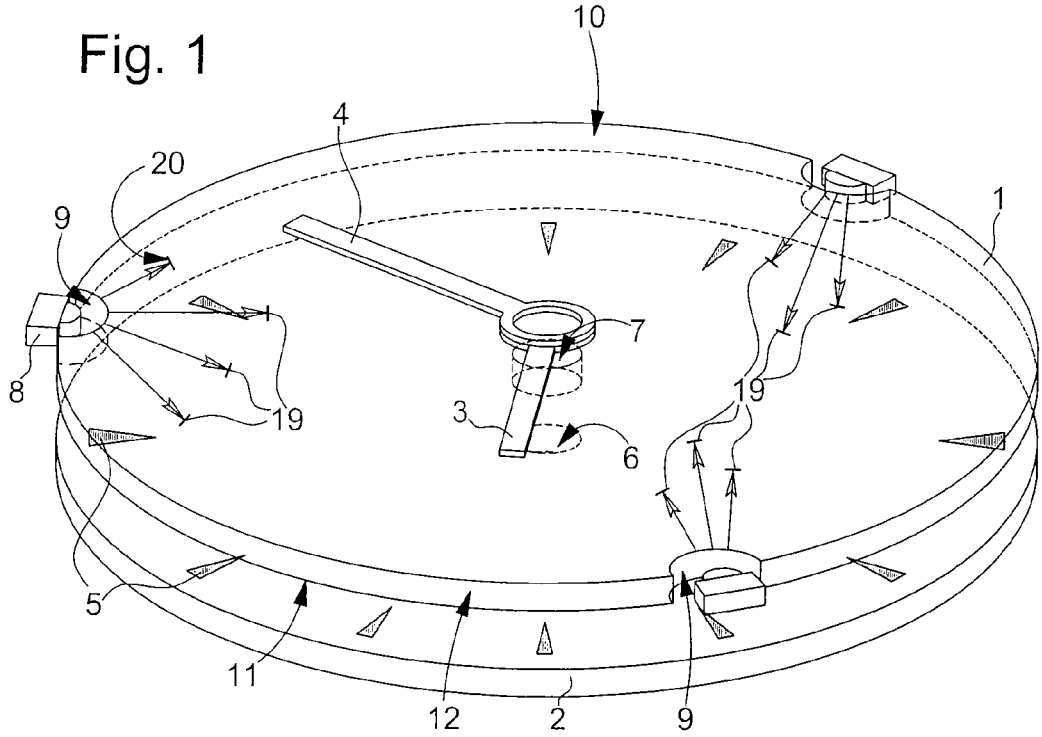
FIG. 1 shows an exploded perspective and schematic view of the display means of an analogue display timepiece according to a first preferred embodiment of the present invention.
Figure 2:
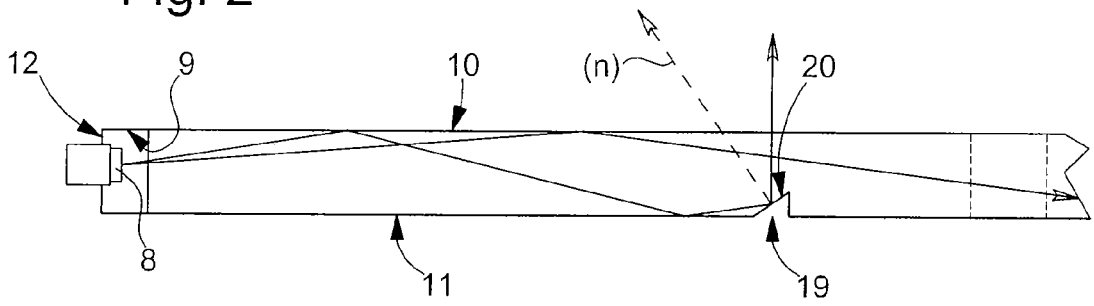
FIG. 2 shows a cross-section of the optical guide shown in FIG. 1.
Figure 2:
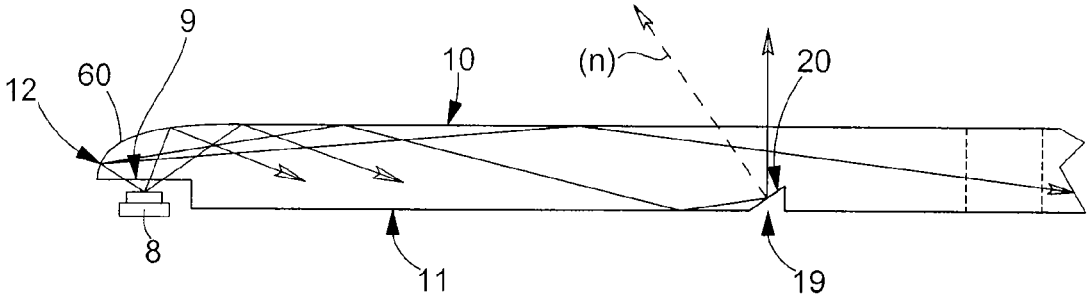

FIGS. 1 and 2 show schematic views respectively in perspective and cross-section of an optical guide 1 according to the present invention.

FIG. 1 shows a possible arrangement of optical guide 1 in a timepiece, namely between dial 2 and hour hand 3 and minute hand 4. Dial 2 and hands 3 and 4 are of a conventional type, dial 2 carrying hour symbols 5 for indicating the position of the hours.

The dial and the optical guide each include a central aperture respectively 6, 7, to allow drive means for hands 3 and 4 to pass, i.e. the hour wheel and the cannon-pinion (not shown in FIG. 1 for the sake of clarity), wherein the optical guide is fixedly mounted on one of the drive means.

In the embodiment shown in FIG. 1, optical guide 1 operates in collaboration with three identical, or possibly different coloured, diodes 8, in order to form a figurative image visible above dial 2 of the timepiece.

From the point of view of the basic principle, a single diode 8 is sufficient to form, in association with a network of optical extractors as described hereinafter, a figurative image.

Preferably, optical coupling between the light beams emitted by each of diodes 8 with optical guide 1 is accomplished through an entry surface 9. Entry surfaces 9 each have substantially the shape of a portion of cylindrical case, such that the beams emitted by the diodes are refracted at the entry into the optical guide. Thus, the angular aperture of each of the light beams is increased to cover most of the optical guide surface.

Optical guide 1 has two main large faces 10 and 11, shown in FIG. 1 substantially in the shape of discs by way of non-limiting illustration, connected to each other by a lateral face 12 that has the general shape of a ring. Light entry surfaces 9 are arranged in lateral surface 12.

The operating principle of the optical system described in relation to FIG. 1 is shown in a diagram in FIG. 2, in which optical guide 1 is shown alone in a transverse cross-section, along a plane intersecting one of diodes 8.

According to the present invention, optical guide 1 includes a plurality of optical extractors 19, only one of which is visible in FIG. 2, arranged on large face 11 located on the side of dial 2.

Optical extractors 19, each of which has at least one reflective surface 20, are distributed in accordance with a predefined network over large face 11, this network being defined to correspond to a very precise figurative image, as explained hereinafter.

Reflective surface 20 has a normal (n) oriented so as to face the corresponding diode 8, at a certain predefined angle. Thus, a certain proportion of the light beams emitted by diode 8 fall onto the reflective surface 20, either by direct incidence, or after one of several prior reflections on at least one of large faces 10 and 11.

The proportion of light beams that interact with reflective surface 20 can be adjusted as a function of certain geometrical parameters of a given extractor, in particular as a function of the distance separating diode 8 from reflective surface 20 and the height of optical extractor 19 in relation to the thickness of optical guide 1. Those skilled in the art will not encounter any particular difficulty in adapting these parameters in accordance with requirements.

First of all, as regards the most general embodiment of the timepiece according to the present invention, all of the optical extractors, provided to form a predefined figurative image, have the same angle with respect to large face 11. This features means that the light beams falling on reflective surface 20 of the network are all deviated in the same direction. Thus, each reflective surface 20 of the network gives rise to the formation of a reflected light beam. The set of reflected light beams form a network of reflected light beams giving rise to a figurative image in a given direction.

In the particular case shown in FIG. 2, the angle between reflective surface 20 and large face 11 is substantially 45 degrees, causing the formation of a figurative image in a direction substantially perpendicular to the large face. Thus, the person wearing the timepiece according to the invention can see a luminous image when he looks at the dial in a substantially normal direction, provided of course that diodes 8 are supplied with electric power.

Of course, the invention is not limited to forming a figurative image in a direction perpendicular to the dial. One could, for example, envisage forming the figurative image in a direction having an angle of the order of 60 degrees in relation to the dial, in the direction of the 6 o'clock position, to allow the user to see it without rotating his forearm to any great extent.

Generally, the direction in which the figurative image is formed is adjusted by the angle formed by the reflecting surface with respect to the incident light beams, the normal (n) of the reflecting surface corresponding to the bisecting line of the diode-reflecting surface direction on the one hand and the reflecting surface-observer direction on the other hand.

Optical guide 1 can be made of any material possessing the required qualities, including in particular transparency as regards light propagation, especially in the visible field. Preferably, the optical guide could be made of a plastic material of the PMMA type, by injection, replication, or by any other suitable method, the advantages of such solutions mainly residing in the corresponding easy manufacturing methods and in the low cost price of the product obtained.

After the preceding explanation, it will be understood that the reflecting surfaces 20 constitute a set of pixels for forming a figurative image. Consequently, the smaller the size of the reflecting surfaces, the better the image resolution and quality.

As already suggested, it should be noted that the higher the optical extractor, the larger its efficient surface and thus, the greater the quantity of light extracted from the optical guide at the corresponding location. Thus, as a result, the luminous intensity of each of the reflected light beams can be finely adjusted via the features of the corresponding optical extractor. On the basis of this adjustment, it becomes possible to form a "grey level" figurative image (in the colour of the diode used) on the basis of a single light source.

Using current manufacturing techniques, it is possible to envisage making optical extractors having dimensions of the order of 10 μm. Moreover, the reflective surface 20 can have various shapes, flat or curved to modulate the form of the reflected beam and make it slightly divergent for example.

Preferably, the optical extractors belonging to the same network have at least one common geometrical feature, namely that the normal to its reflecting surface is contained in a plane which is perpendicular both to optical guide land to the corresponding entry surface 9. This feature that is shown in a diagram in FIG. 1 guarantees that light extraction is optimum, which is more advantageous from the electric energy consumption point of view of the timepiece in which the light decoration of the present invention is implemented.

The structure shown in FIG. 1, implementing an optical guide 1 illuminated by three light sources advantageously allows a multi-coloured image to be formed.

For this purpose the light sources emit light radiations of different respective colours, each of the sources being associated with its own optical extractor network.

According to a simple variant, each of the three optical extractor networks can be arranged in an area of optical guide 1 located in proximity to the diode 8 associated therewith, as shown in the diagram of FIG. 1.

Alternatively, each of the three networks can be spread over a large part of the total optical guide surface, possibly interlaced with each other. An example of a figurative image obtained with this configuration is described hereinafter, in relation to the detailed description of FIGS. 3*a*, 3*b*, 3*c* and 3*d*.

Figure 3A:
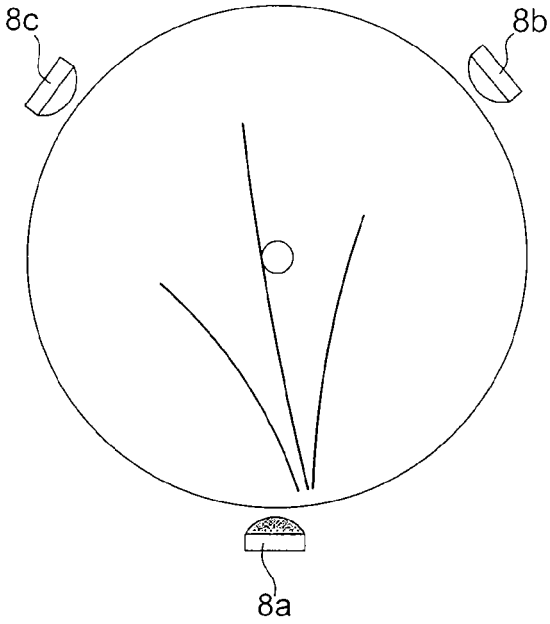
FIGS. 3*a*, 3*b*, 3*c* and 3*d* show schematically an example of images formed in succession to define an animated pattern.
Figure 3B:
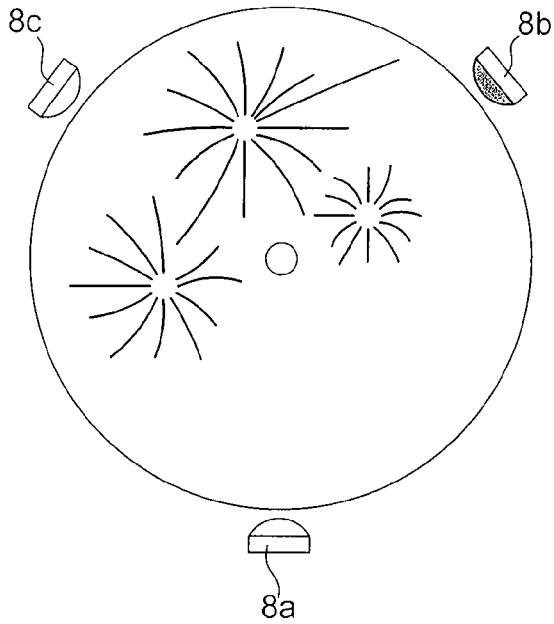
Figure 3C:
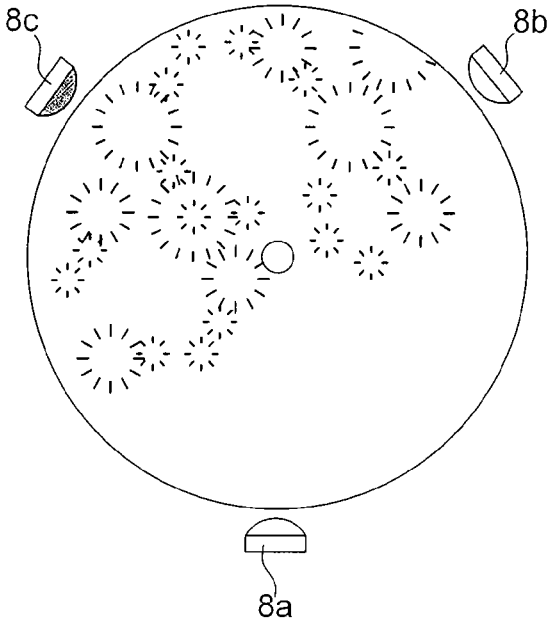

FIGS. 3*a* to 3*c* show schematically the figurative image formed by each of the three optical extractor networks cooperating with a given light source.

The timepiece corresponding to the diagrams of FIG. 3 includes three diodes 8, arranged substantially facing the 6 o'clock (reference 8*a* in FIG. 3), 2 o'clock (reference 8*b*) and 10 o'clock (reference 8*c*) positions.

Figure 3D:
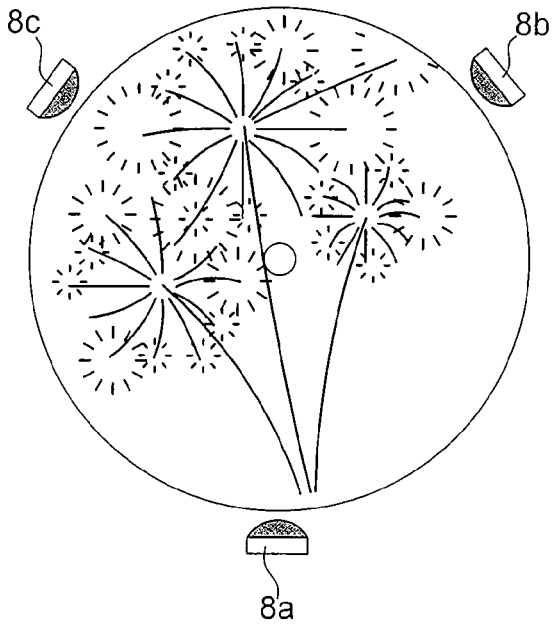

Each of diodes 8*a*, 8*b*, 8*c* is associated with a given optical extractor network. FIG. 3*a* shows the figurative image formed, as it appears to the person wearing the timepiece according to the present invention, when diode 8*a* is being powered to emit light in the direction of the network associated therewith. Likewise, FIGS. 3*b* and 3*c* show the figurative images respectively formed during operation of diodes 8*b* and 8*c*. FIG. 3*d* shows the multi-coloured figurative image formed when the three diodes 8*a*, 8*b* and 8*c* are simultaneously powered.

On the basis of this structure with three diodes and three interlaced optical extractors, a plurality of operating modes can be provided.

For example the electronic circuits of the watch can be programmed in accordance with the present invention such that the three diodes 8*a*, 8*b* and 8*c* are simultaneously powered in response to activation of a control member by the user. The corresponding function has an advantage beyond simply adding aesthetic appeal, in that the figurative image formed is luminous and can thus allow the person wearing the watch to identify the position of the hands when he is in a dark environment.

Alternatively or by way of complement, the electronic circuits of the watch can be programmed such that diodes 8*a*, 8*b* and 8*c* are powered sequentially in response to a different activation of the control member or in response to a different activation of an additional control member. It is clear that the present invention is not limited to the nature and operating modes of the control member or members.

By way of example, the three diodes could be simultaneously powered in response to a shock detected by an accelerometer arranged in the watch.

With a sequential type operating mode, a multi-coloured animation display is obtained, namely letting off fireworks in the case of the example shown in FIGS. 3*a* to 3*d*.

FIG. 3*a* shows a diagram of the display of the first figurative animation image, obtained by the collaboration of the light beams emitted by first diode 8*a* with a first optical extractor network. The person wearing the watch can see a luminous figurative image symbolising the trace left by rockets during a firework display from above the dial.

FIG. 3*b* shows a diagram of the display of the second figurative animation image obtained by the collaboration of the light beams emitted by second diode 8*b* with a second optical extractor network. The person wearing the watch can see a luminous figurative image symbolising the main explosions of rockets fired in the first step of the firework display.

FIG. 3*c* shows a diagram of the display of the third figurative animation image, obtained via the collaboration of the light beams emitted by the third diode 8*c* with a third optical extractor network. The person wearing the watch can see a luminous figurative image symbolising secondary rocket explosions.

Thus, when the three diodes 8*a*, 8*b* and 8*c* are powered sequentially, the person wearing the watch can see the firework being lit, followed by two series of explosions.

Those skilled in the art will of course be able to provide different variants of the animation that has just been described without departing from the scope of the present invention. For example, following the display of the third figuration image of the animation described hereinbefore, the three diodes 8*a*, 8*b* and 8*c* could be simultaneously powered to form the complete firework image.

Moreover, on the basis of the preceding description, a significant number of variants of the timepiece with a luminous pattern display according to the present invention can be provided.

By way of example, two optical extractor networks could be arranged on the same waveguide, wherein the light beams have different directions of reflection. In this case, two different figurative images are formed, visible from two different positions. According to an alternative embodiment, the two directions of direction could have an angle between them such that the two images formed constitute a stereogram when the observer's eyes are placed at a given distance above the optical guide.

Figure 4:
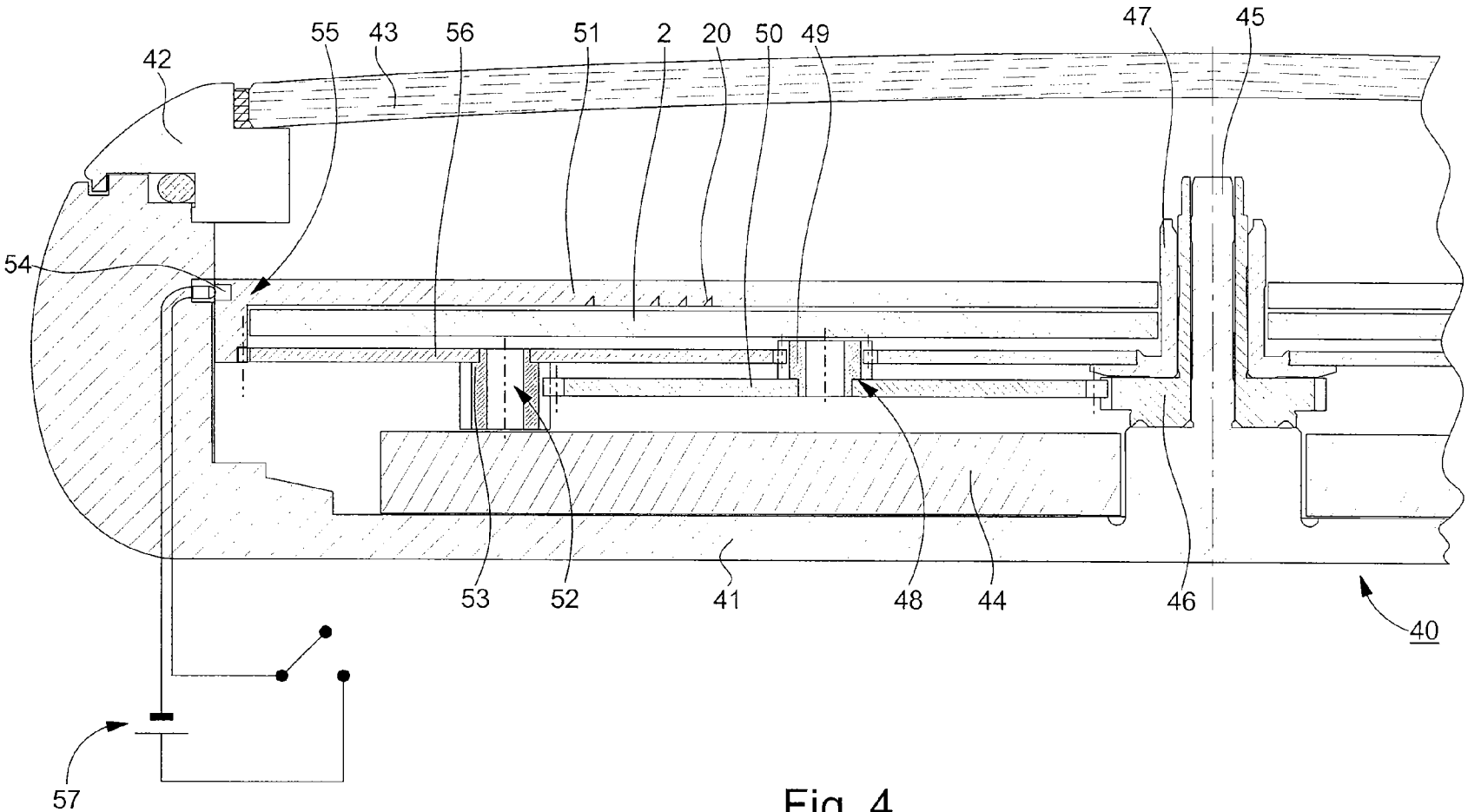
FIG. 4 shows a simplified cross-section of a timepiece according to a variant of the present invention.

A particular embodiment example is shown in FIG. 4, schematically, in the form of a partial transverse cross-section of a timepiece incorporating a luminous pattern display device according to the present invention. In this embodiment, an optical guide is driven in a movement of rotation about the minute and hour hand drive axis.

According to this particular embodiment timepiece 40 includes at least one first and one second light source 8 arranged to emit light inside said optical guide along different transmission directions, additional means 52, 54, 55 being provided for driving optical guide 51 in rotation such that the plurality of optical extractors cooperate alternately with the first and second light sources 8.

Electromechanical timepiece 40 includes a back cover-middle part 41, closed by a bezel 42 and a crystal 43. A conventional type of electronic movement has been represented by a block 44 to avoid overloading the diagram.

Back cover-middle part 41 can be made by plastic injection moulding, a central stud 45 being formed in one piece with the back cover-middle part, the main function of the latter being to carry the cannon-pinion 46 and the hour wheel 47. The cannon-pinion and the hour wheel are connected to each other conventionally via a motion work 48, formed by a minute pinion 49 and a minute wheel 50.

A dial 2 is mounted above these gear trains, and an optical guide 51 similar to optical guide 1 described in relation to the description of FIG. 1 is mounted above the dial, wherein the dial 2 and the optical guide 51 include an aperture to allow the cannon-pinion 46 and the hour wheel 47 to pass. The dial and the optical guide can be centred by central stud 45 which passes the aperture and/or held in their respective axial positions by conventional means (not shown), such as, for example, by resting on suitable shoulders of the middle part, wherein the optical guide is fixedly mounted on one of the cannon-pinion 46 and the hour wheel 47.

According to this embodiment, an additional intermediate wheel set 52 is provided, whose pinion 53 meshes with minute wheel 50.

Moreover, optical guide 51 has an annular shoulder 54 perpendicular to its large faces, arranged on the periphery of the optical guide and extending in the direction of the timepiece movement. The shoulder 54 carries a toothing 55 arranged on its inner surface to mesh with wheel 56 of intermediate wheel set 52. Because of the kinematic chain implemented between the cannon-pinion and the optical guide, the latter can be driven in rotation in the same rotational direction as the display hands (not shown).

Further, at least one diode 8 is arranged in a suitable place in the middle part located opposite optical guide 51, electric connection means being provided to connect the electric terminals of the diode to the supply terminals of the battery (symbolised by the reference 57 in FIG. 4) used for the electric power supply of the timepiece. Diode 8 is advantageously arranged in an area of the middle part covered by the bezel to prevent it being visible through the timepiece crystal.

Preferably, four diodes 8 are arranged, respectively, between the 1 o'clock and 2 o'clock positions, between the 4 o'clock and 5 o'clock positions, between the 7 o'clock and 8 o'clock positions and between the 10 o'clock and 11 o'clock positions. One or several entry surfaces 9 similar to those described in relation to the description of FIG. 1 can be arranged at particular locations on the lateral face of optical guide 51. If four diodes are arranged in the timepiece, between one and four entry surfaces 9 are provided.

Further, the features of the kinematic chain responsible for driving the optical guide could be such that optical guide 51 is driven at the same speed as the minute hand.

On the basis of the structure described hereinbefore, various operating modes can be implemented as regards the formation of decorative patterns.

In a basic embodiment, one optical extractor network 20 can be arranged inside an area corresponding to a quadrant of the total surface of optical guide 51, the quadrant being for example arranged such that the minute hand forms the bisecting line thereof.

According to a preferred implementation, the four diodes 8 emit light beams in different colours.

When the quadrant bearing the optical extractor network, called the decorative quadrant, is centred opposite one of diodes 8, the latter being powered to emit light, a decorative pattern with maximum luminous intensity is obtained. When the decorative quadrant is in a different position from its centred position, as has just been described, the luminous intensity of the decorative pattern formed decreases as the quadrant moves away from its centred position.

Thus, the user can activate the decorative pattern display, for example by activating a control member, the colour and luminous intensity of the pattern depending upon the position of the minute hand with respect to the timepiece dial.

Of course, it is possible to omit entry surfaces 9 if one wishes to smoothen the variations in luminous intensity, i.e. in the latter case, transmission from a diode into the optical guide occurs in the same way whether the quadrant is in its centred position or not.

Conversely, when entry surfaces 9 are arranged in the lateral face of waveguide 51, light transmission is optimum from a diode to the inside of the optical guide when one of the entry surfaces is located opposite one of the diodes. When the optical guide is driven in rotation, the diode concerned is gradually located opposite the annular-shaped lateral face of the optical guide, the latter being less favourable to light transmission to the inside of the optical guide. The difference in light transmission quality inside the optical guide leads to a significant variation in the luminous intensity of the decorative pattern formed. The luminous intensity then progressively decreases while reflective surfaces 20 are oriented less and less opposite diode 8.

While the optical guide is rotating, the decorative quadrant moves closer to the next diode. Thus, when the latter is powered, the decorative pattern is formed with increasing luminous intensity progressively as the quadrant bisecting linemoves closer to the diode.

The example that has just been described is presented by way of non-limiting example. Alternatively, the decorative pattern could cover a larger surface than one quadrant of the optical guide. Optical guide 51 could also include a plurality of optical extractor networks without departing from the scope of the present invention, like for example one network per quadrant allowing four decorative patterns to be simultaneously formed, the colour of each pattern being different from those of the other patterns.

However, a second optical guide (not shown) could also be provided, superposed on optical guide 51 and controlled by the rotation of the hour hand. For this purpose, an optical guide of this type can be directly driven onto the hour wheel pipe before setting the hour hand in place. Preferably, a set of additional diodes could be arranged in the middle part, opposite the additional optical guide.

Alternatively, the hour and minute hands could be replaced by rotating discs, in a known manner. In such case, the present invention is implemented by making the hour and minute indicating discs in the form of two optical guides. A first of these two optical guides includes a network of optical extractors, which, when they are illuminated, form a luminous pattern having the shape of an hour hand. The second optical guide includes a network of optical extractors, which when they are illuminated, form a luminous pattern having the shape of a minute hand. A set of three or four diodes regularly distributed around the watch dial can then be provided to illuminate the optical guides with a maximum of different incident directions.

Those skilled in the art will not encounter any difficulty in providing the number of diodes necessary for implementing the device according to the invention properly, in accordance with their requirements, and particularly as a function of the free space available underneath the bezel for arranging the diodes. It should be noted that from the point of view of electric power consumption and space, it is preferable to implement a single set of diodes, this being possible when the efficient light beam transmission height of a diode is sufficient to substantially cover the thickness of the two joined optical guides.

According to a variant shown in FIG. 2*b* is, for each light source a diode 8 is used, oriented orthogonally to a large face 11 of optical guide 1, i.e. it emits light rays directed overall vertically upwards, whereas in the embodiment shown in FIG. 2, diode 8 emits light rays directed overall orthogonally to large face 12.

Diode 8 is arranged here underneath optical guide 1, still in proximity to large face 12. Entry surface 9 is parallel here to the two large faces 10, 11. Preferably, the peripheral portion 60 of the top large face 10 of optical guide 1 is curved towards bottom large face 11 so that the light rays, which are emitted by diode 8 in the direction of the periphery of optical guide 1, can be totally reflected onto peripheral portion 60 and be directed towards reflective surfaces 20 associated with diode 8.

This variant enables "top emitting diodes" to be used, relative to the printed circuit board face on which they are mounted, as opposed to side emitting diodes.

From the point of view of the operation of the timepiece described hereinbefore, the diodes could be not powered permanently for energy saving reasons. Thus, the display of luminous patterns respectively having the form of the hour and minute hands can be controlled by the electronic circuits of the watch in response to the activation of a control member, for example. The timepiece then has an original and discreet appearance while offering excellent legibility when the diodes are being powered to implement the time display.

The preceding description corresponds to preferred embodiments of the invention and should in no way be considered limiting, more particularly as regards the structure described for the watch, the nature and number of control members used or the position of the diodes. Likewise, the invention is not limited to the operating modes described and means used for the respective actuation thereof insofar as such parameters can be altered by suitable programming of the controller circuit. Those skilled in the art will not encounter any particular difficulty in adapting the operation of the watch according to the present invention to fit their particular requirements. In particular, as suggested hereinbefore, each of the optical extractors can be made in the form of a raised portion having at least one light extraction surface through which light is refracted when it leaves the optical guide.

Numerous variants can be implemented without departing from the scope of the present invention, such as not arranging a dial in the watch, the optical guide performing this function directly and the hand drive trains being adapted to have an attractive appearance for the person wearing the watch. Along the same lines, the optical guide could be directly formed by the watch crystal. In such case, the crystal includes optical extractors arranged in its inner face, one or several light sources being arranged in the bezel area so as to emit light beams in the direction of the edge of the crystal.

Additional features could also be provided without departing from the scope of the present invention, such as for example covering the lateral face of the optical guide with a reflective coating, outside the entry surfaces, to limit losses of light due to light beams reaching the lateral face and being liable to leave the optical guide.

The invention claimed is:

1. An electronic device, comprising:

(a) a watch case; and (b) an optical device, housed in the watch case, for forming at least one figurative image in a first predefined direction in relation to the watch case; the optical device including (1) at least one optical guide having two large faces and at least one lateral face;

(2) at least one light source, that emits light beams inside the optical guide; and (3) optical extractors, disposed so that the light emitted by the light source cooperates with the optical extractors that are arranged on one of the large faces to form the figurative image;

wherein the optical guide includes at least two networks of optical extractors, a first network of optical extractors corresponding to a first figurative image, and a second network of optical extractors corresponding to a second figurative image;

wherein the at least one light source includes a first light source arranged to cooperate with the first network of optical extractors, and a second light source arranged to cooperate with the second network of optical extractors;

wherein each of the optical extractors has predefined geometrical features including at least one reflective or refractive surface, which has a normal so as to face the corresponding light source, at a certain predefined angle, such that the light beams emitted by the light source that are reflected or refracted, respectively, by one of the first or the second networks of optical extractors, to form a network of light beams that generates a figurative image in the direction of an observer;

wherein each light source is arranged in proximity to the lateral face of the optical guide, each light source emitting light in a predefined direction such that the light is reflected on the reflective surface, or the light is refracted on the refractive surface, respectively, of the corresponding network of optical extractors;

wherein the first and second networks of optical extractors are interlaced on the large face of the optical guide; and wherein when the first and second light sources are simultaneously powered, the interlaced first and second networks of optical extractors are simultaneously illuminated to produce a first figurative image and a second figurative image, respectively, and wherein the first and second figurative images together form a complete figurative image.

2. The electronic device according to claim 1, wherein each light source is arranged facing the lateral face in a predefined direction for emitting light inside the optical guide and cooperating with the reflective or refractive surface, respectively, to form the corresponding figurative image.

3. The electronic device according to claim 1, wherein each light source is oriented in an orthogonal direction to one of the large faces.

4. The electronic device according to claim 1, wherein the two light sources are powered sequentially.

5. The electronic device according to claim 1, wherein the two light sources are arranged for emitting light inside the optical guide along different directions, additional means being provided for driving the optical guide in rotation such that the optical extractors cooperate alternately with the first and second light sources.

6. The electronic device according to claim 1, wherein each light source is capable of emitting light in several colour ranges.

7. The electronic device according to claim 1, wherein the respective colours of said first and second light sources belong to different ranges.

8. The electronic device according to claim 1, wherein the optical device includes at least two networks of optical extractors whose respective geometrical features are defined such that the associated figurative images are formed in different respective directions.

9. The electronic device according to claim 8, wherein said different figurative image forming directions are defined so as to form a stereogram.

10. The electronic device according to claim 1, wherein the electronic device forms a timepiece in which the watch case is closed by a crystal, wherein the optical device is housed inside the watch case such that the figurative image is visible through the crystal.

11. The electronic device according to claim 10, wherein the electronic device includes a dial above which the optical guide is arranged.

12. The electronic device according to claim 10, wherein the optical guide also performs the function of a dial.

13. The electronic device according to claim 10, wherein the optical guide also performs the function of a crystal.

14. The electronic device according to claim 10, wherein the watch case has a bezel, each light source being arranged at least partially underneath the bezel.

15. The electronic device according to claim 10, wherein a watch movement and an analogue display are provided, the optical guide having an aperture allowing driving elements of display hands to pass, and wherein the optical guide is fixedly mounted on one of said driving elements.

16. The electronic device according to claim 1, wherein the at least one optical guide is substantially dial-shaped.

17. The electronic device according to claim 1, wherein when the first and second light sources are simultaneously powered, the interlaced first and second networks of optical extractors are simultaneously illuminated to produce a first figurative image and a second figurative image, respectively, and wherein the first and second figurative images together form a multi-colored figurative image.

18. The electronic device according to claim 17, further comprising an accelerometer, wherein the first and second light sources are simultaneously powered by activation of the accelerometer.

19. The electronic device according to claim 1, further comprising an accelerometer, wherein the first and second light sources are simultaneously powered by activation of the accelerometer.

* * * * *